United States Patent [19]

Strobe

[11] 4,054,242

[45] Oct. 18, 1977

[54] NOVELTY PACKAGE

[75] Inventor: Carl J. Strobe, Atlanta, Ga.

[73] Assignee: The Pangburn Co., Fort Worth, Tex.

[21] Appl. No.: 657,050

[22] Filed: Feb. 11, 1976

[51] Int. Cl.[2] ..... A63H 33/00; B04B 27/04

[52] U.S. Cl. ..... 229/71; 40/124.1; 46/36; 46/37

[58] Field of Search ..... 46/35–37; 40/124.1; 229/71, 73

[56] References Cited

U.S. PATENT DOCUMENTS

| | | | |
|---|---|---|---|
| 850,150 | 4/1907 | Glazier | 46/36 |
| 3,225,474 | 12/1965 | Dusseau | 46/34 |
| 3,566,483 | 3/1971 | Axelrod | 46/37 |
| 3,946,508 | 3/1976 | Booras | 46/37 |

*Primary Examiner*—Louis G. Mancene
*Assistant Examiner*—Robert F. Cutting
*Attorney, Agent, or Firm*—Jones, Thomas & Askew

[57] ABSTRACT

A novelty package formable from a single blank, the package including a primary panel having a window, a secondary panel behind the primary panel and having a first area normally visible through the window and a second area visible through the window on sliding of the panels with respect to each other, and a flexible back on the package for normally holding the panels in a first position while allowing the panels to be slid with respect to each other. The package is intended to retain a product without impairing the slidable relation of the panels.

6 Claims, 8 Drawing Figures

NOVELTY PACKAGE

This invention relates to novelty packaging apparatus, and is more particularly concerned with a package having an animation facility.

It is sometimes desirable to package items in novelty packaging that will attract prospective customers. When the prospective customers are primarily children it is further desirable to make the package itself a toy or a novelty item that can be retained after the goods within the package are consumed.

While many attempts have been made to devise a package, or a part thereof, that will be retained as a novelty, most of such items take the form of simply an insert for a package or require a very expensive box or the like. Also, many of the prior art attempts to provide a retainable novelty require a large amount of cutting, pasting, and construction to convert the package into a novelty. Such requirements are not suited to small children, and are not immediately appealing while in packaging form.

The present invention overcomes the above-mentioned and other difficulties with the prior art packaging by providing a package for generally flat goods, the package being producible from a single piece of sheet material appropriately cut and folded. The package includes a primary panel having at least one window therein, with a secondary panel adjacent to the primary panel and slidable with respect to the primary panel. The secondary panel includes information thereon, at least some of such information being visible through the window in the primary panel when the primary panel and secondary panel are appropriately placed with respect to each other. The package further includes retaining means to hold goods within the package, and resilient means to urge the secondary panel towards a predetermined position with respect to the primary panel.

These and other features and advantages of the present invention will become apparent from consideration of the following specification when taken in conjunction with the accompanying drawings in which.

Figure 1:
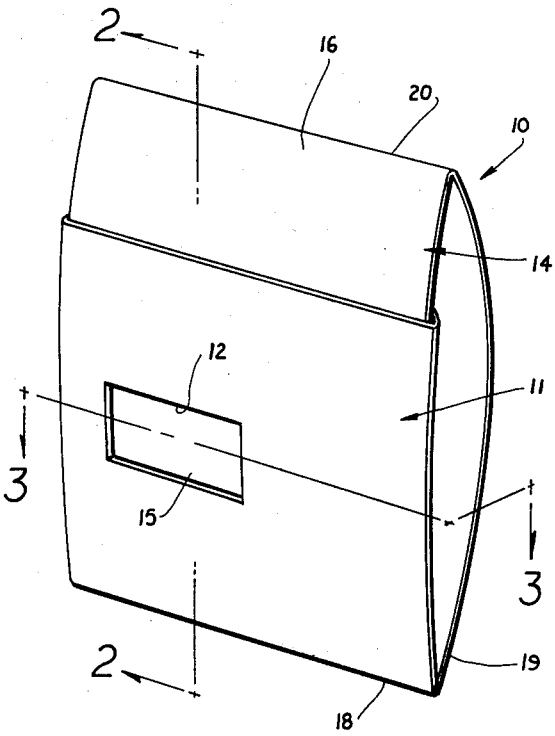
FIG. 1 is a perspective view of one form of package made in accordance with the present invention.

Referring now more particularly to the drawings, and to those embodiments of the invention here chosen by way of illustration, it will be seen in FIG. 1 that the package 10 includes a primary panel 11 having a window 12 therein, and a secondary panel 14 that is immediately adjacent to the primary panel 11 and slidable with respect thereto. An area 15 of the secondary panel 14 is visible through the window 12, and an area 16 of the secondary panel 14 is visible above the primary panel 11. The lower edge 18 of the primary panel 11 is connected to a back panel 19, and the upper edge 20 of the secondary panel 14 is connected to the same back panel 19.

At this point it should be understood generally that information will be on the secondary panel 14 in at least one selected location. The information may not be visible while the package is in the condition shown in FIG. 1; however, the secondary panel 14 is slidable with respect to the primary panel 11 to expose the information through the window 12.

Figure 3:
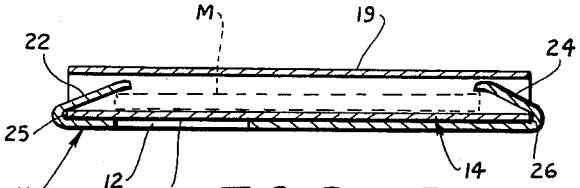
FIG. 3 is a cross-sectional view taken substantially along the line 3—3 of FIG. 1.
Figure 2:
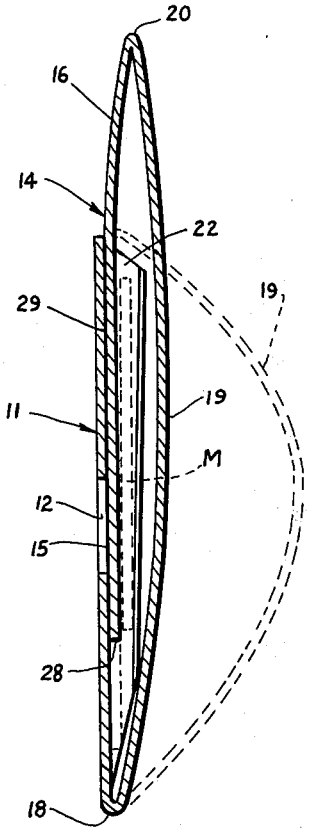
FIG. 2 is a cross-sectional view taken substantially along the line 2—2 of FIG. 1.

This operation will be better understood with reference to FIGS. 2 and 3 of the drawings where it will be seen that the primary panel 11 has, along opposed edges thereof, a pair of tabs designated at 22 and 24, the tabs 22 and 24 extending generally the full height of the primary panel 11 but being folded rearwardly as best shown in FIG. 3 of the drawings. Since the tabs 22 and 24 are folded towards each other to approach a position in which they would be lying against the back side of the primary panel 11, it will be seen that a pair of channels 25 and 26 is formed; and, it is within these two channels 25 and 26 that the secondary panel 14 slides. It is also between these two channels 25 and 26, and between the two tabs 22 and 24 that a peice of merchandise is held as indicated at M and shown in broken line in FIGS. 2 and 3 of the drawings.

Due to the presence of the tabs 22 and 24, it will be understood that the primary panel 11 of the package 10 will remain substantially flat and unbendable; however, the secondary panel 14 remains a single thickness of fiberboard or the like and it is somewhat flexible. Primarily at FIG. 2 of the drawings, it will be seen that the secondary panel 14 is lying against the back side of the primary panel 11 with the area 15 of the secondary panel 14 adjacent to the window 12. It should also be seen that the back panel 19 is formed by a single thickness of fiberboard or the like and is somewhat flexible; as a result, pressure exerted between the bottom edge 18 and the top edge 20 will result in bowing of the back panel 19 so that the secondary panel 14 will slide within the channels 25 and 26, thereby sliding with respect to primary panel 11 until the lowermost edge 28 of the secondary panel 14 reaches the bottom fold of the primary panel 11. During this process, it will be understood that the back panel 19 will bow as indicated in the broken line representation in FIG. 2.

Since the secondary panel 14 will move with respect to the primary panel 11, it will be understood that a different portion 29 of the secondary panel 14 will be exposed through the window 12 of the primary panel 11.

Figure 4:
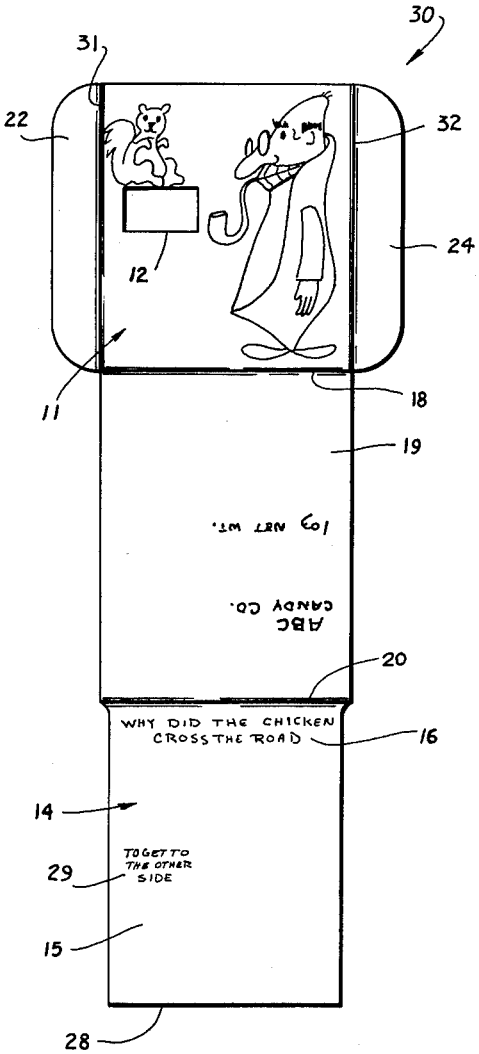
FIG. 4 is a plan view showing a blank for forming a package of the type shown in FIG. 1.

Referring now to FIG. 4 of the drawings, it will be seen that the blank 30 for forming the package 10 is shown in unfolded form. For ease in understanding, the same numerals as have been applied to the package 10 are shown on the blank 30 where it will be seen that the primary panel 11 and the tabs 22 and 24 extending laterally therefrom are connected by fold lines 31 and 32. The window 12 is simply a hole provided within the primary panel 11.

The back panel 19 is attached to the lower edge of the primary panel 11, the edge 18 being shown in FIG. 4 as a fold line. It will be seen that the back panel 19 is substantially the same width as the primary panel 11, the side edges of the back panel 19 being generally coextensive with the fold lines 31 and 32.

The secondary panel 14 is attached to the end of the back panel 19 at the upper edge of the secondary panel 14, the upper edge 20 appearing as a fold line. It will be seen in FIG. 4 that the secondary panel 14 is somewhat narrower than the back panel 19, the reason being that the secondary panel 14 must be of such width as to be received between the tabs 22 and 24 and to be slidable with respect to the primary panel 11.

It will therefore be seen that, in order to form the package 10 from the blank 30, it is necessary only to fold the tabs 22 and 24 rearwardly to generally overlap the rear side of the primary panel 11, then crease the blank 30 along the lines 18 and 20 so that the three panels 11, 19 and 14 will lie in parallel planes; the secondary panel 14 can then be lifted, bent somewhat, and inserted into the channels 25 and 26 formed by the tabs 22 and 24. When the back panel 19 is generally straight, the area 15 of secondary panel 14 will be visible through the window 12 and when the back panel 19 is curved as shown in FIG. 2 of the drawings, area 29 of the secondary panel 14 will be visible through the window 12.

Figure 5:
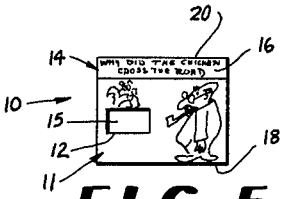
FIG. 5 is a front elevational view of a package showing one piece of information thereon visible with the secondary panel in a first position.
Figure 6:
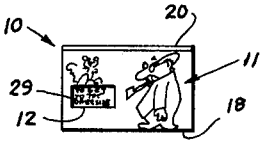
FIG. 6 is a front elevational view of the package shown in FIG. 5 with the secondary panel in a second position.

Looking now at FIGS. 5 and 6 of the drawings, it will be seen that the package 10 is shown in FIG. 5 with the area 16 of the secondary panel visible above the primary panel 11. By way of example, it will be seen in FIG. 5 that a riddle is presented in the area 16, but the answer is not visible on the package. By pressing on the package, on the upper edge 20 and the lower edge 18, the secondary panel 14 will move with respect to the primary panel 11 to cause the area 29 to be aligned with the window 12, and the answer to the riddle is printed on the area 29 so that the riddle disappears and the answer to the riddle appears in the window 12.

Figure 7:
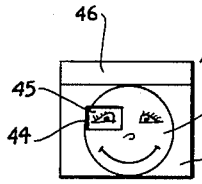
FIG. 7 is a front elevational view similar to FIG. 5 but showing a different form of information.
Figure 8:
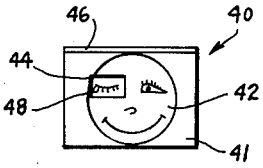
FIG. 8 is a front elevational view similar to FIG. 6 but showing the package of FIG. 7.

Looking at FIG. 7 and 8 of the drawings, it will be seen that a different form of information can be provided on the package, this form of package being designated as the package 40. The package 40 shown in FIG. 7 has a primary panel 41 with a drawing 42 printed thereon. The window 44 exposes an area 45 of the secondary panel 46, and the area 45 has a portion of the total drawing 42. In this arrangement of the package, it will be seen that, when the secondary panel 46 is moved with respect to the primary panel 41, the area 48 of the secondary panel 46 is exposed in the window 44 so that a variation in the drawing 42 is presented. By this means it will be understood that a certain degree of animation of a figure can be achieved.

From the foregoing, it should be understood by those skilled in the art that the package of the present invention provides a very simple package that can be formed from a single blank and the package is adaptable to hold various forms of flat items such as candy mints, wafers and the like. The package itself can be wrapped with a transparent wrapper so that the printing on the package is visible while the package is on the shelf for sale; thus, the prospective purchaser can manipulate the package even before unwrapping the package to obtain the goods.

Though the package of the present invention has been described in terms of being constructed of fiberboard or the like, it should be understood that the invention contemplates construction from other materials including transparent plastic materials. In the event the construction material is transparent it will be recognized that the main body of the package can be printed to be substantially opaque, and the window can be left unprinted and transparent rather than being cut out.

It will of course be understood that the particular embodiments of the invention here chosen are by way of illustration only and are meant to be in no way restrictive; therefore, numerous changes and modifications may be made and the full use of equivalents resorted to without departing from the spirit or scope of the invention as defined in the appended claims.

I claim:

1. A novelty package for receiving and retaining a product, said package comprising:

a primary panel having a window defined therethrough;

a secondary panel adjacent to said primary panel and slidably assembled with respect thereto, a first area of said secondary panel being normally visible through said window, and a second area of said secondary panel being visible through said window upon sliding of said secondary panel with respect to said primary panel;

a back panel attached to the upper edge of said secondary panel and to the lower edge of said primary panel, and spaced apart from said primary and secondary panels to define a space therebetween for receiving the product within said novelty package;

said back panel being longer than the combined length of said primary and secondary panels in assembly, so that said back panel provides a resilient means for normally urging said secondary panel to a first position in which said first area is visible through said window, and for yieldingly permitting said secondary panel to be slidably displaced to a second position with respect to said primary panel to align said second area with said window; and means associated with said primary panel to retain the product within said space in either slidable relation of said primary and secondary panels.

2. A novelty package as claimed in claim 1, wherein the dimension of said secondary panel in the direction of said slidable movement is a predetermined dimension so that said secondary panel, when slidably displaced to said second position, contacts the joinder of said primary panel lower edge and said back panel lower edge, so that said product receiving space remains sufficiently large for nondamaging retention of such product.

3. A novelty package as claimed in claim 1, in which said product retaining means comprises a pair of tabs, each tab of said pair of tabs being fixed to an edge of said primary panel and extending into said product receiving space, said tabs defining sides to said package.

4. A novelty package as claimed in claim 1, wherein said secondary panel further includes a third area visible above said primary panel when said secondary panel is in said first position, and including a first piece of information printed on said third area, and a related piece of information printed on said second area.

5. A novelty package as claimed in claim 1, and including a first piece of information printed on said first area, and a piece of related information printed on said second area.

6. A novelty package as claimed in claim 1, said primary panel and said secondary panel being of generally the same height, said back panel being of a height generally equal to the height of said primary panel plus the height of said third area.

* * * * *